United States Patent [19]

Oguri

[11] Patent Number: 4,526,079

[45] Date of Patent: Jul. 2, 1985

[54] AUTOMATIC RHYTHM PERFORMANCE DEVICE FOR ELECTRONIC MUSICAL INSTRUMENTS

[75] Inventor: Shigenori Oguri, Hamamatsu, Japan

[73] Assignee: Nippon Gakki Seizo Kabushiki Kaisha, Hamamatsu, Japan

[21] Appl. No.: 537,631

[22] Filed: Sep. 30, 1983

[30] Foreign Application Priority Data

Oct. 19, 1982 [JP] Japan ..... 57-183266

[51] Int. Cl.[3] ..... G10F 1/00

[52] U.S. Cl. ..... 84/1.03; 84/DIG. 12

[58] Field of Search ..... 84/1.01, 1.27, 1.03, 84/DIG. 12, 1.24, DIG. 25

[56] References Cited

U.S. PATENT DOCUMENTS 3,965,790 6/1976 Suzuki et al. ..... 84/1.27

4,305,319 12/1981 Linn ..... 84/1.01

4,442,745 4/1984 Gross et al. ..... 84/1.01

4,449,437 5/1984 Cotton, Jr. et al. ..... 84/1.27 X

*Primary Examiner*—Forester W. Isen

*Attorney, Agent, or Firm*—Spensley Horn Jubas & Lubitz

[57] ABSTRACT

An automatic rhythm performance device of an electronic musical instrument having an expression pedal is constructed of an operation amount detector, a rhythm selector, and a rhythm tone generator. The operation amount detector detects the operation amount of the expression pedal. The rhythm selector selects a rhythm to be performance among a plurality of rhythms. The rhythm tone generator generates rhythm tones which have rhythm patterns determined by the selected rhythm respectively, the number of rhythm tones to be sounded increasing automatically in proportion to the operation amount. This increment of rhythm tones further enriches a musical tone produced by manual performance whose volume is increased by the expression pedal operation.

10 Claims, 13 Drawing Figures

AUTOMATIC RHYTHM PERFORMANCE DEVICE FOR ELECTRONIC MUSICAL INSTRUMENTS

BACKGROUND OF THE INVENTION

1. Field of the Invention

The present invention relates to an electronic musical instrument having an automatic rhythm performance device, and more particularly to an electronic musical instrument capable of changing the number of rhythm tones played in response to operation of an expression pedal (hereinafter referred to as an "EXP pedal") for sound volume adjustment.

2. Description of the Prior Art

Prior electronic musical instruments such as electronic organs having an automatic rhythm performance device are capable of increasing the volume of musical tones produced by a keyboard in response to operation of an EXP pedal, of enriching a harmony in response to operation of a tone lever, and of increasing a sound pitch thereby strengthening the effect of performance. However, rhythm tones are fixed throughout the performance of a music piece once a particular rhythm is selected. Therefore, rhythm tones based on one selected rhythm source will be simply repeated from the beginning to the end of a music piece played.

Some electronic organs have a rhythm variation switch for changing rhythm patterns. However, the rhythm variation switch fails to change rhythm sources and thus is incapable of sufficiently enhancing the effect of performance of rhythm tones. As a player of an electronic organ gets involved more and more deeply in the performance of a music piece, the player is normally inclined to devote all his efforts to the playing of the keyboard. The rhythm variation switch is usually mounted on a panel or a key block and hence cannot easily be operated upon.

To solve the difficulty in actuating the rhythm variation switch during performance, Japanese Patent Preliminary Publication No. 58-18694 discloses an arrangment for automatically producing a bass drum sound when the EXP pedal is depressed beyond a certain stroke. With this arrangement, a bass drum sound and various other rhythm tones are automatically performed according to respective rhythm patterns read out of a pattern memory in response to a count from a tempo counter. When the EXP pedal is depressed beyond a certain depth, only the bass drum sound is automatically replaced with a bass drum sound successively produced in minimum rhythm units constituting its rhythm pattern in response to a bass drum sound signal from a percussive-instrument-sound adding circuit. However, since the prior rhythm tone is suddenly replaced with a successive bass drum sound when the volume of the musical tone played goes higher than a certain level, a smooth increase in the volume of the musical tone played by the keyboard is not fully matched by a buildup in automatic rhythm performance.

SUMMARY OF THE INVENTION

With the foregoing prior problems in view, it is an object of the present invention to provide an electronic musical instrument having an automatic rhythm performance device for successively increasing the number of automatically played rhythm instrument sounds in response to depression of an EXP pedal.

The number of rhythm instrument sounds produced is automatically increased as the volume of musical tones produced by a keyboard with an EXP pedal, that is, as the performance of keyboard musical tones is built up. Therefore, the performance of keyboard musical tones is further enriched by the automatic rhythm performance strengthened in response to a buildup of the keyboard musical tones.

Another object of the present invention is to provide an electronic musical instrument including an automatic performance device for enriching the performance of keyboard musical tones with rhythm instrument sounds by changing a rhythm pattern read out of a pattern memory into another rhythm pattern matching a buildup in the keyboard musical tone performance in response to depression of an EXP pedal.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
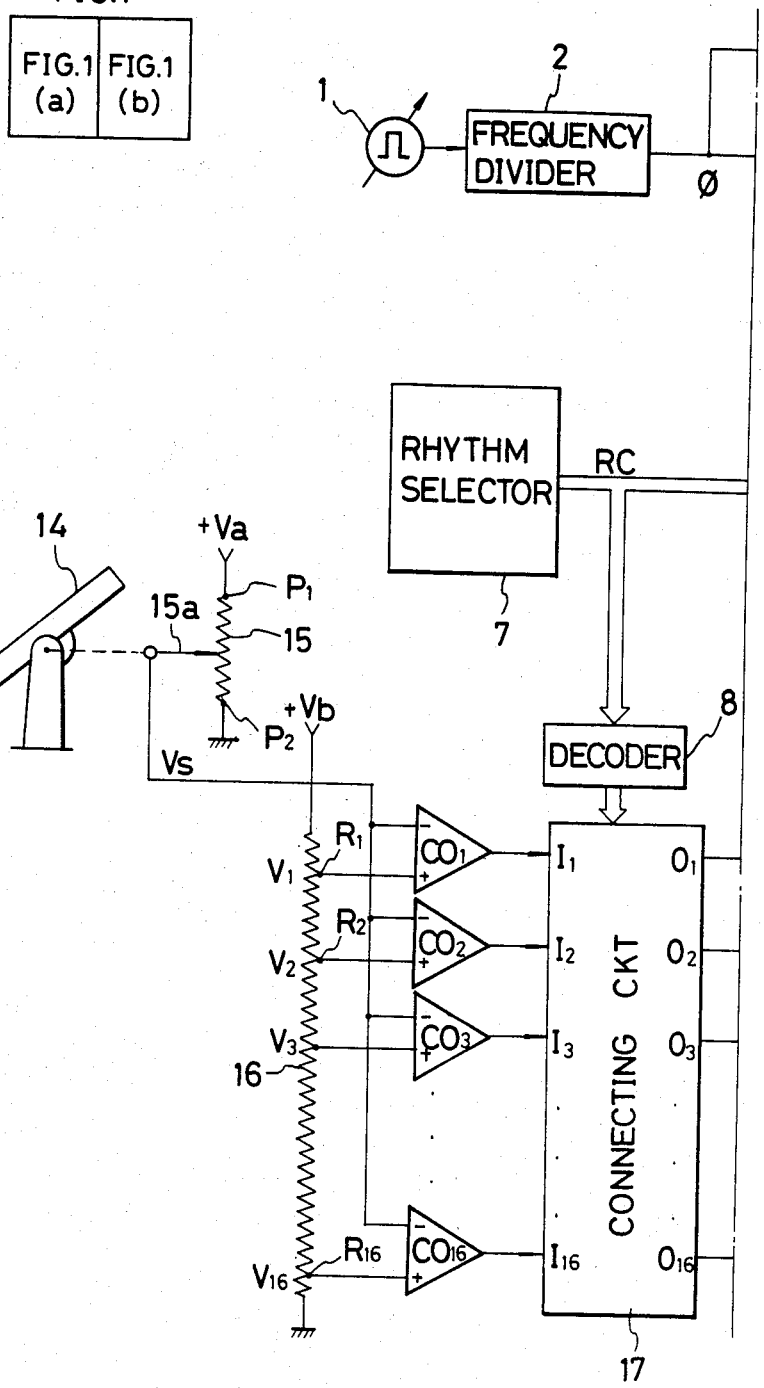
FIG. 1 is a block diagram of an electronic musical instrument according to a first embodiment of the present invention.
Figure 1:
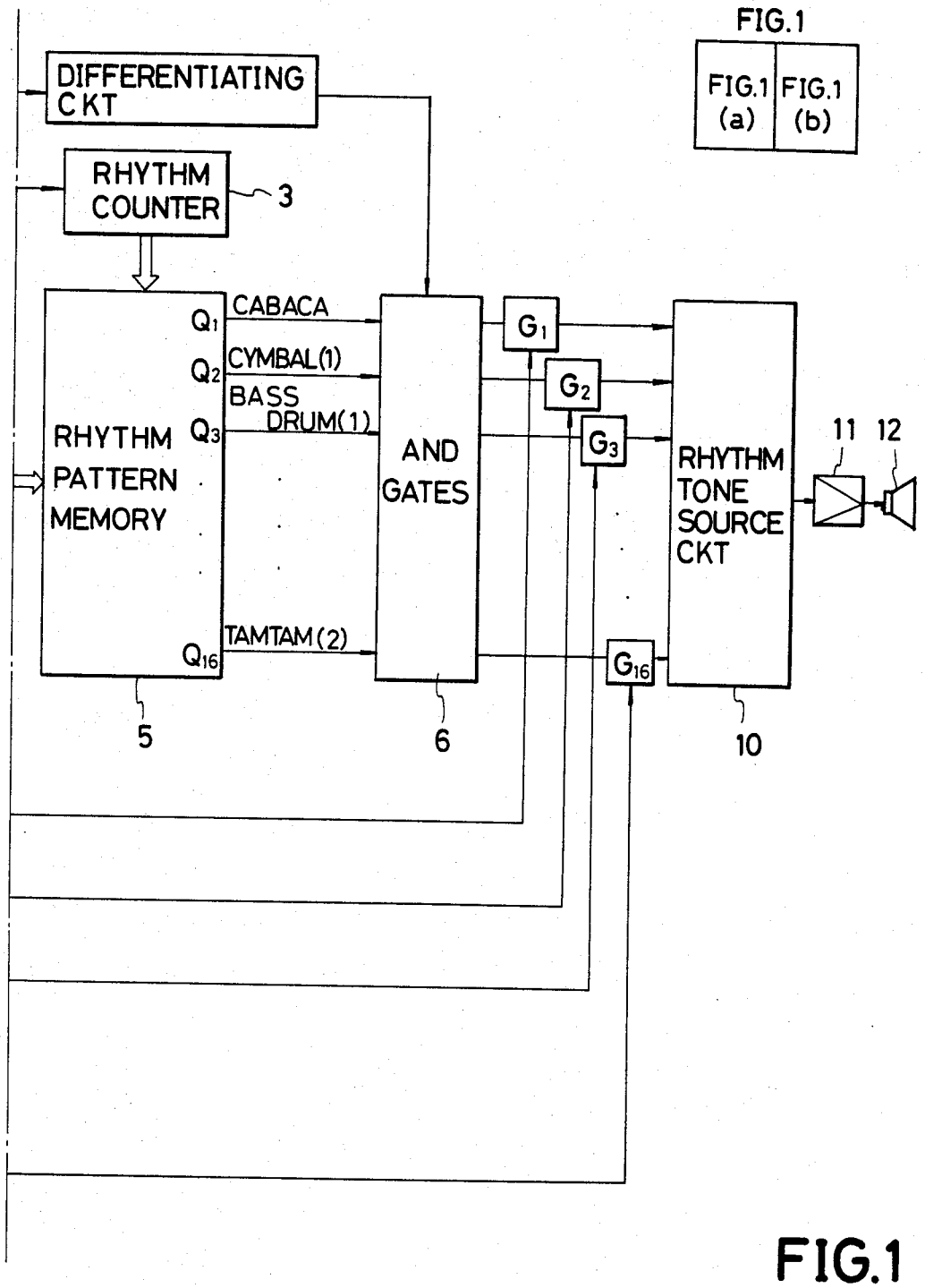

FIG. 1 shows in block form an electronic musical instrument constructed according to a first embodiment of the present invention. The electronic musical instrument of the illustrated embodiment is capable of producing keyboard musical tones and rhythm tones. FIG. 1 illustrates only an automatic rhythm performance device for producing rhythm tones, and a keyboard and a circuit for producing keyboard musical tones are omitted from illustration. The automatic rhythm performance device shown is capable of performing a maximum of 16 rhythm tones for each rhythm played.

The electronic musical instrument illustrated in FIG. 1 includes an oscillator 1 for producing an output which is frequency-divided by a frequency divider 2 that generates clock pulses supplied to a rhythm counter 3 and a differentiating circuit 4. Each of the clock pulses Ø serves as a minimum unit for rhythm patterns. The rhythm counter 3 counts the clock pulses Ø in response to positive-going edges thereof. The rhythm counter 3 may comprise a modulo-16 counter, for example, and issues a count output to a rhythm pattern memory 5. The differentiating circuit 4 produces a pulse signal of reduced pulse duration in response to the positive-going edge of each clock pulse Ø, the pulse signal produced being supplied to AND gates 6. A rhythm selector 7 is composed of a plurality of rhythm selection switches for selecting rhythms such as rumba, bossa nova, 8-beat and others, and an encoder for encoding outputs from the rhythm selection switches. The rhythm selector 7 serves to encode the output from the rhythm selection switch operated upon and supplies the encoded output as a rhythm code RC to the rhythm pattern memory 5 and a decoder 8.

Figure 2:
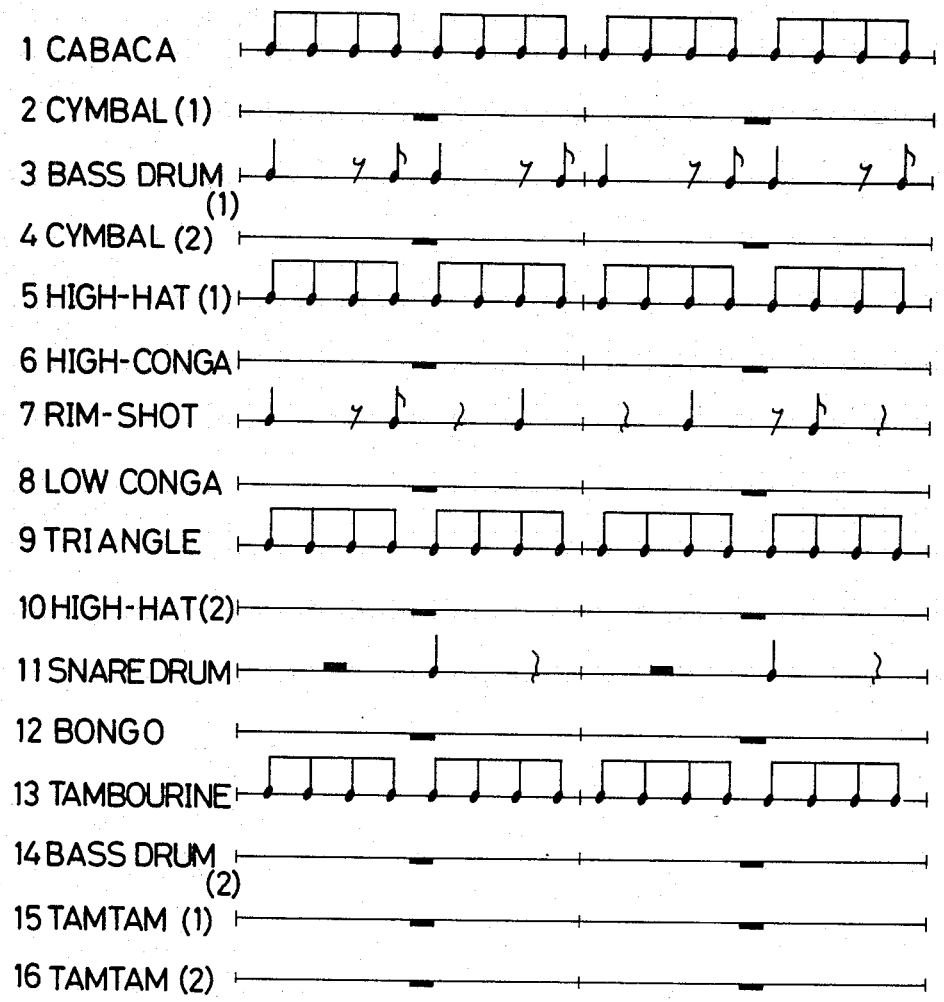
FIG. 2 is a diagram showing a rhythm pattern of bossa nova.

The rhythm pattern memory 5 comprises a ROM (read-only memory) having a decoder contained therein and stores 16 rhythm patterns for each of the rhythms (rumba, bossa nova, 8-beat, for example). FIG. 2 shows a rhythm pattern for a rhythm of bossa nova, for instance. The rhythm pattern memory 5 stores such rhythm patterns as 1's and 0's for the respective rhythms. When a rhythm to be played is specified by the rhythm code RC, the rhythm patterns of the specified rhythm are repeatedly issued in parallel from output terminals Q1–Q16 in response to the count output from the rhythm counter 3. In the illustrated embodiment, a rhythm pattern of CABACA is issued from the output terminal Q1, a rhythm pattern of CYMBAL(1) from the output terminal Q2, . . . , and a rhythm pattern of TAMTAM(2) from the output terminal Q16. The output terminals Q1–Q16 produce the same rhythm tones irrespective of the rhythms selected.

The AND gates 6 issue signals on input terminals thereof from output terminals thereof only when a pulse signal is applied from the differentiating circuit 4. The rhythm patterns delivered from the rhythm pattern memory 5 are converted by the AND gates 6 into rhythm pulses which are supplied through gates G1–G16 to a rhythm tone source circuit 10. The rhythm tone source circuit 10 is composed of a rhythm source of CABACA, a rhythm source of CYMBAL(1), a rhythm source of TAMTAM(2), these rhythm sources being capable of producing rhythm tone signals each time a rhythm pulse is supplied. The rhythm tone signals produced are mixed together and supplied through an amplifier 11 to a loudspeaker 12 from which a rhythm tone is generated.

An EXP pedal 14 for keyboard tones is operatively connected with a variable resistor 15 for detecting the degree of depression of the EXP pedal 14. The variable resistor 15 has a slider 15*a* movable in response to operation of the EXP pedal 14. When the EXP pedal 14 is not depressed at all, the slider 15*a* is positioned at one end P1 of the variable resistor 15. As the EXP pedal 14 is depressed, the slider 15*a* is shifted toward the other end P2. When the EXP pedal 14 is fully depressed, the slider 15*a* is positioned at the end P2 of the variable resistor 15. A voltage +Va is applied to the end P1 of the variable resistor 15, and the other end P2 is connected to ground. The slider 15*a* applies a voltage Vs to negative input terminals of comparators CO1–CO16.

The comparators CO1–CO16 produce output signals "0" when the voltages at their negative input terminals are greater than voltages at their positive input terminals, and produce output signals "1" when the voltages at their negative input terminals are smaller than voltages at their positive input terminals. The positive input terminals of the comparators CO1–CO16 are connected to taps R1–R16 of a resistor 16. A voltage +Vb (Vb=Va) is applied to an end of the resistor 16, the other end of which is grounded. The taps R1–R16 impose voltages V1–V16, respectively, on the positive input terminals of the comparators CO1–CO16. The comparators CO1–CO16 have output terminals connected respectively to input terminals I1–I16 of a connecting circuit 17.

Figure 3:
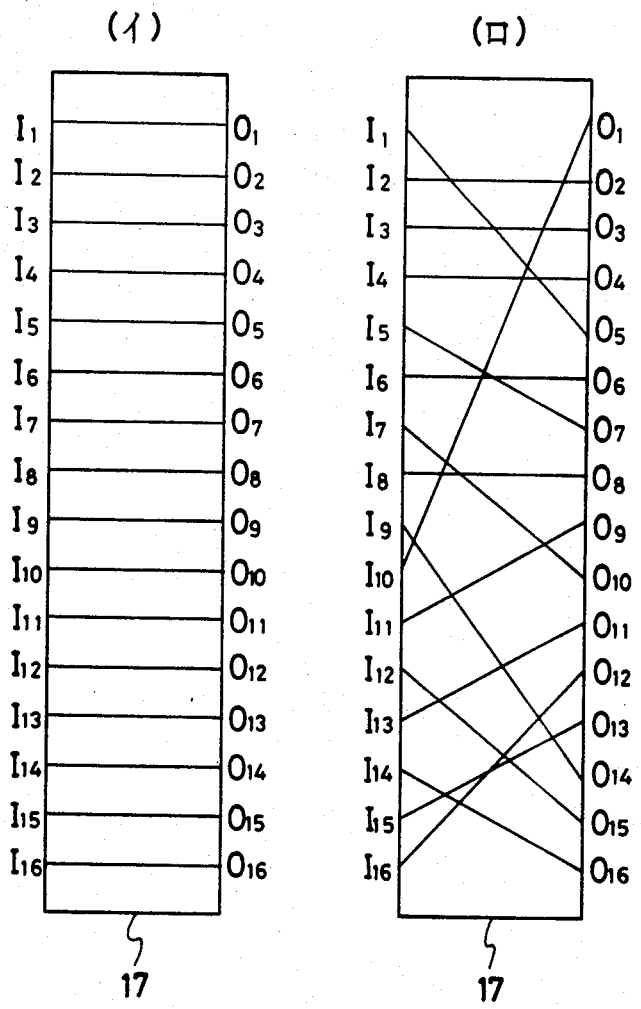
FIGS. 3(A) and 3(B) are diagrams showing connecting patterns, by way of example, in a connecting circuit in the electronic musical instrument shown in FIG. 1.

The connecting circuit 17 serves to connect its input terminals I1–I16 to output terminals O1–O16 thereof. Interconnection between the input terminals I1–I16 and the output terminals O1–O16 is determined by the output (rhythm code RC) from the decoder 8. For example, when a rhythm code of bossa nova is issued from the rhythm selector 7, the input terminals I1–I16 are connected respectively to the output terminals O1–O16 as shown in FIG. 3(A). When a rhythm code of 8-beat is issued from the rhythm selector 7, the input terminals are connected to the output terminals in a pattern as shown in FIG. 3(B); the input terminal I1 is connected to the output terminal O5, the input terminal I2 to the output terminal O2, the input terminal I16 to the output terminal O12, for example. The signals from the output terminals O1–O16 of the connecting circuit 17 are supplied to control terminals of the gates G1–G16, respectively.

Operation of the electronic musical instrument of the foregoing construction will be described. It is assumed that the rhythm selector 7 issues the rhythm code RC of bossa nova. The rhythm pattern as shown in FIG. 2 is repeatedly issued from the output terminals Q1–Q16 of the rhythm pattern memory 5, and the output signals from the rhythm pattern memory 5 are converted by the AND gates 6 into rhythm pulses which are supplied respectively to the input terminals of the gates G1–G16.

If the EXP pedal 14 is not depressed at all at this time, then the slider 15*a* is positioned at the end P1 of the variable resistor 15, and the voltages Vs and V1–V16 have the following relationship:

$$Vs > V1 > V2 > \ldots > V16$$

As a result, the outputs from the comparators CO1–CO16 become signals of "0" which are supplied respectively to the input terminals I1–I16 of the connecting circuit 17. At this time, the connecting circuit 17 has the terminal connection pattern as illustrated in FIG. 3(A), and hence the outputs (signals of "0") from the comparators CO1–CO16 are fed respectively to the control terminals of the gates G1–G16 to thereby close the latter. Consequently, no rhythm pulses are supplied to the rhythm tone source circuit 10, and no rhythm tones are generated from the loudspeaker 12.

If the player of the electronic musical instrument slightly depresses the EXP pedal, and the voltage Vs drops so that $$V1 > Vs > V2,$$

then only the output from the comparator CO1 becomes a signal of "1" which is fed through the connecting circuit 17 to the control terminal of the gate G1, thus opening the latter. With the gate G1 open, the rhythm pulses of CABACA are supplied through the gate G1 to the rhythm tone source circuit 10 in which the source of the rhythm tone CABACA is driven for thereby energizing the loudspeaker 12 to produce a rhythm tone of CABACA. As the player successively depresses the EXP pedal 14, the outputs from the comparators C02, C03, . . . successively become signals of "1" to thereby open the gates G2, G3, . . . , successively. Thus, a rhythm tone of CYMBAL(1), a rhythm tone of BASS DRUM(1), . . . are successively produced by the loudspeaker 12. When the EXP pedal 14 is fully depressed by the player, all of the gates G1–G16 are opened to enable the loudspeaker 12 to generate all of the rhythm tones as shown in FIG. 2. If the rhythm patterns are all rests (caused by signals of "0" in the rhythm pattern memory 5) such as the tone of CYMBAL(1) and the tone of CYMBAL(2) in FIG. 2, then no rhythm tones are produced even when the corresponding gates are open.

When the player selects the rhythm of 8-beat through the rhythm selector 7, the rhythm selector 7 issues the rhythm code RC of 8-beat which is fed to the rhythm pattern memory 5 and the decoder 8. The rhythm pattern of 8-beat is issued from the output terminals Q1–Q16 of the rhythm pattern memory 5, and the outputs from the rhythm pattern memory 5 are converted by the AND gates 6 into rhythm pulses that are delivered to the input terminals of the gates G1–G16. The connecting circuit 17 has the terminal connecting pattern as illustrated in FIG. 3(B) at this time.

Figure 4:
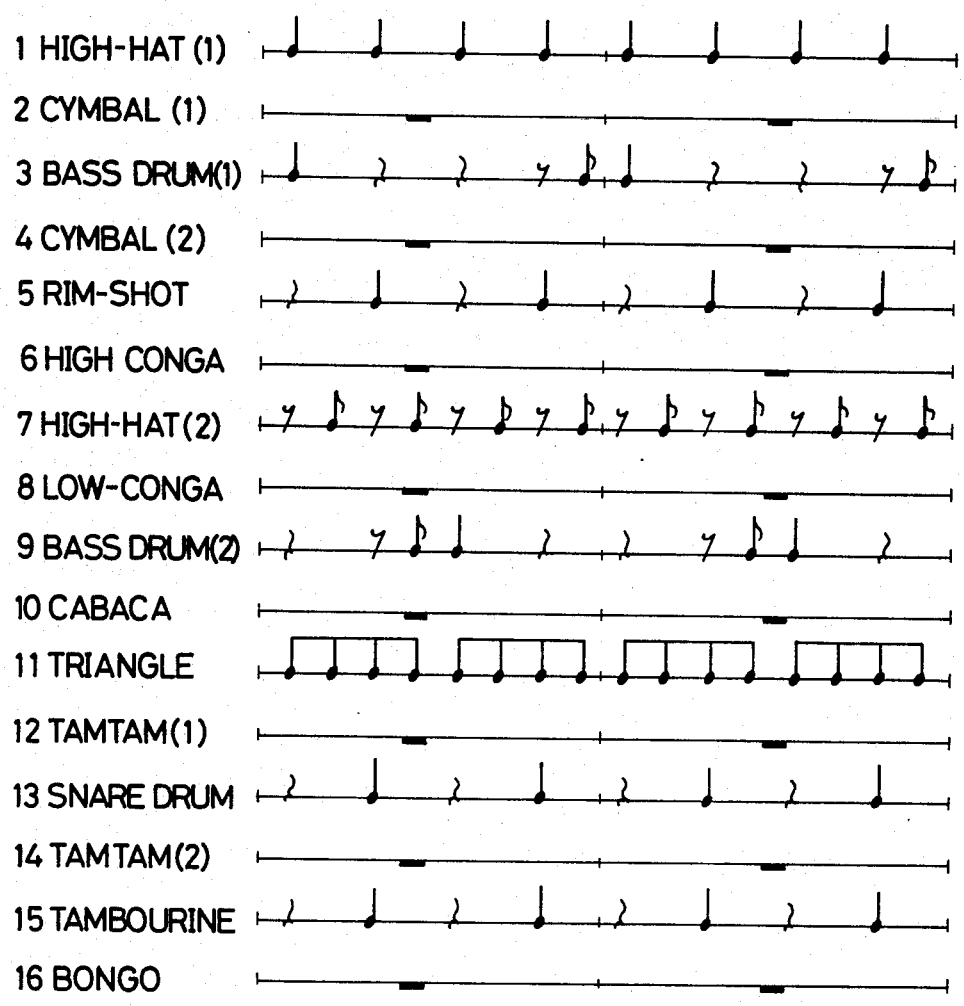
FIG. 4 is a diagram illustrating a rhythm pattern of 8-beat.

If the EXP pedal 14 is not depressed at all at this time, the gates G1–G16 remain all closed, and no rhythm tones are generated by the loudspeaker 12. As the player depresses the EXP pedal 14 slightly to the extent where the voltage Vs and V1, V2 have the following relationship:

$$V1 > Vs > V2,$$

the output from the comparator CO1 becomes a signal of "1" which is supplied through the connecting circuit 17 to the control terminal of the gate G5. The gate G5 is therefore opened to enable the loudspeaker 12 to produce a rhythm tone of HIGH-HAT(1). As the player successively depresses the EXP pedal 14, the gates G2, G3, . . . are successively opened to allow corresponding rhythm tones to be produced successively. FIG. 4 shows the rhythm patterns of 8-beat in the order generated in response to continued depression of the EXP pedal 14.

With the arrangement of FIG. 1, the number of rhythm tone sources driven is increased as the EXP pedal 14 is more and more depressed. The greater the extent of depression of the EXP pedal 14, the more rhythm tones performed.

Figure 5:
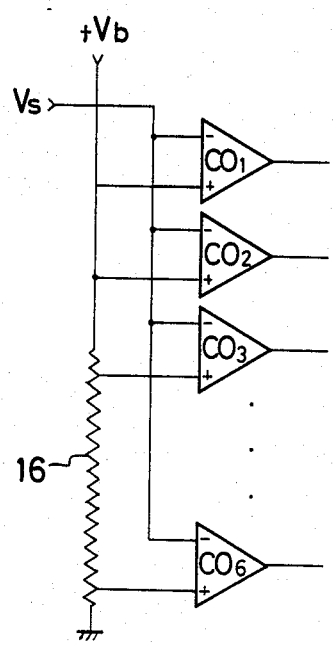
FIGS. 5 and 6 are block diagrams of modifications in the circuit arrangement of FIG. 1.

FIG. 5 shows a modification in which the positive input terminals of the comparators CO1, C02 are connected to the line of voltage Vb, and the voltage Vb is selected to be slightly greater than the voltage Va. This arrangement allows the outputs from the comparators CO1, C02 to be a signal of "1" to drive the rhythm tone sources corresponding to the comparators CO1, CO2 at the time the EXP pedal 14 is not depressed at all. The same operation can be effected by determining the level of the voltage Va as $V3 < Va < V2$ in the arrangement of FIG. 1.

Figure 6:
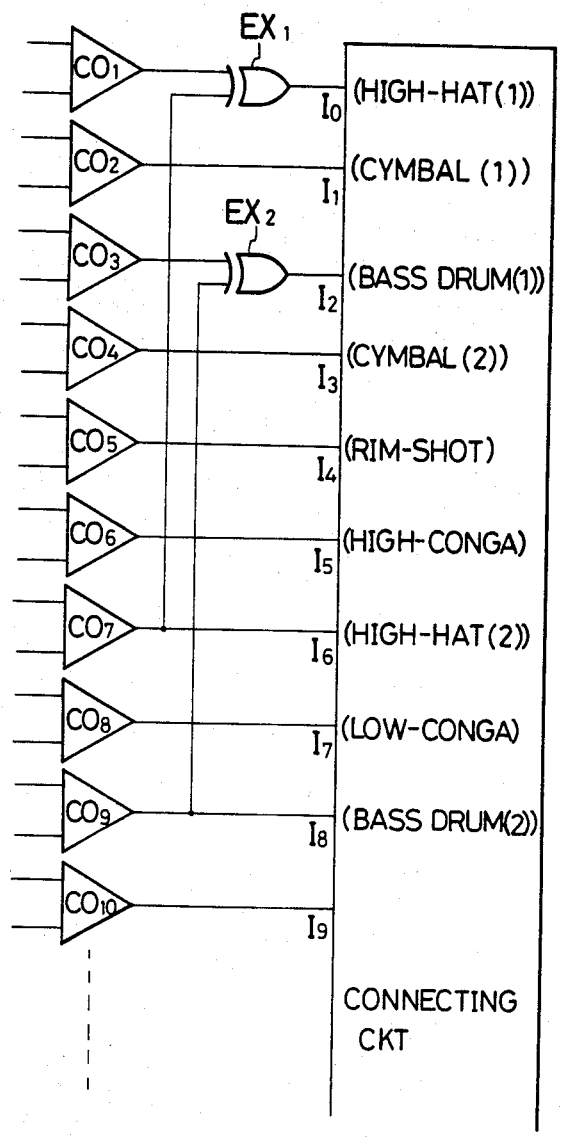

According to a modification shown in FIG. 6, exclusive-OR gates EX1, EX2 are connected to the output terminals of the comparators CO1, CO7 and CO3, CO9 in the rhythm selection mode in which the rhythm code RC of 8-beat is selected by the rhythm selector 7. With this arrangement, the tone of HIGH-HAT(1) is produced only when the output of the comparator CO1 becomes a signal of "1". When the output from the comparator CO7 becomes a signal of "1" in response to depression of the EXP pedal 14, the tone of HIGH-HAT(1) is not generated, but the tone of HIGH-HAT(2) is produced. The tones of BASS DRUM(1) and BASS DRUM(2) are produced in the similar manner. The rhythm pattern can therefore be varied in response to depression of the EXP pedal 14 even where the rhythm tone sources in the rhythm tone source circuit 10 remain the same.

Figure 7:
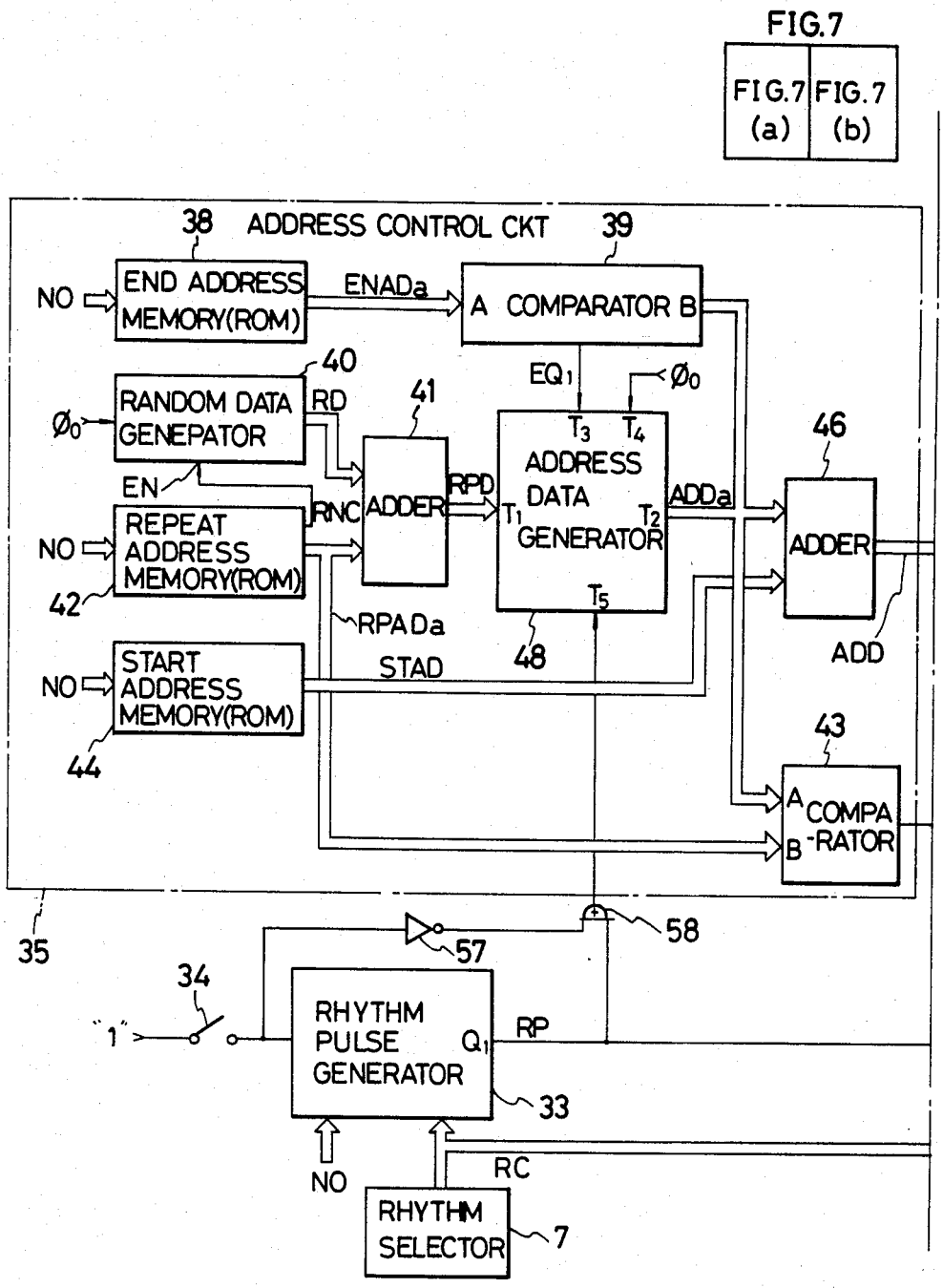
FIG. 7 is a block diagram of an electronic musical instrument according to a second embodiment of the present invention.
Figure 7:
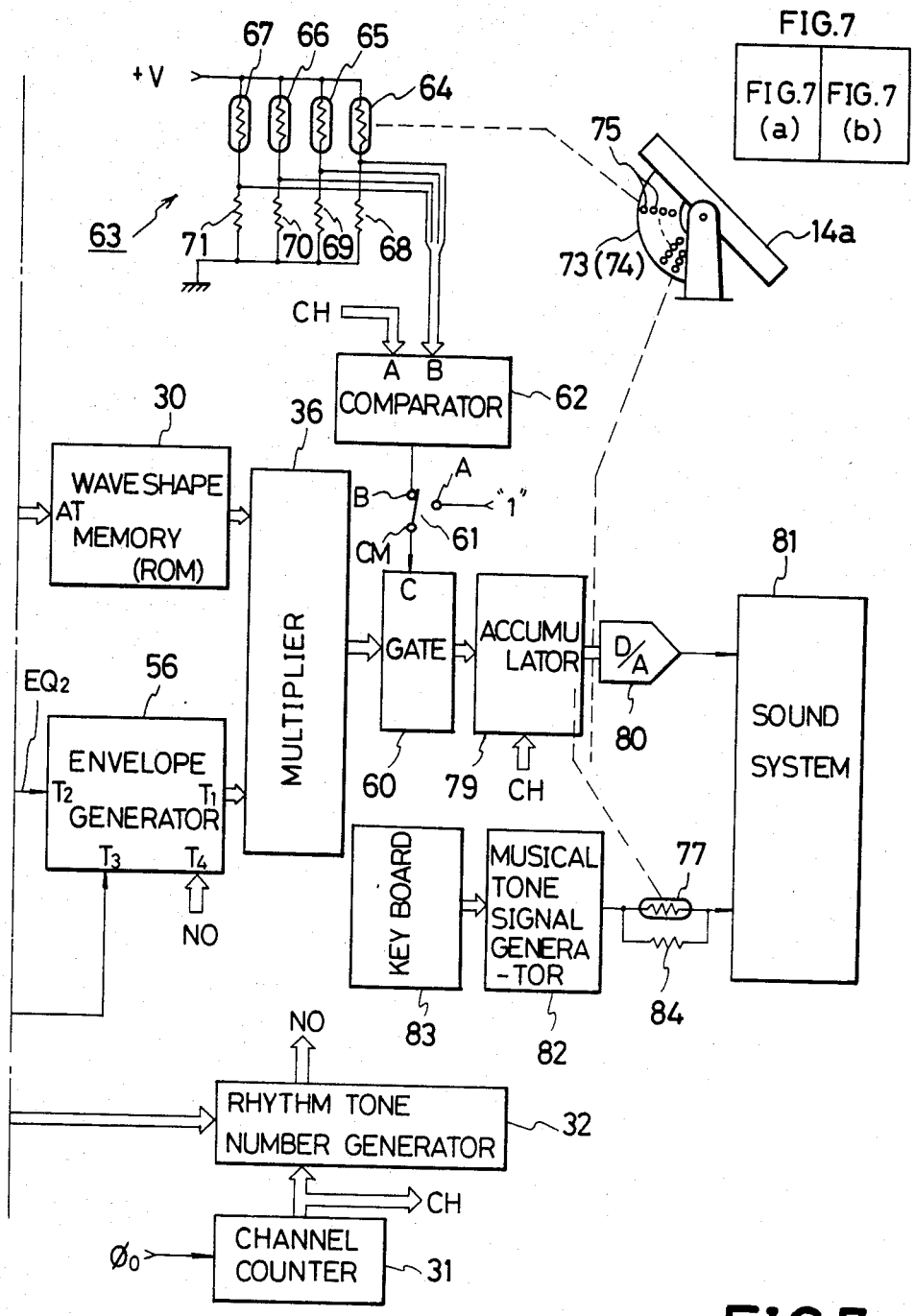
Figure 8:
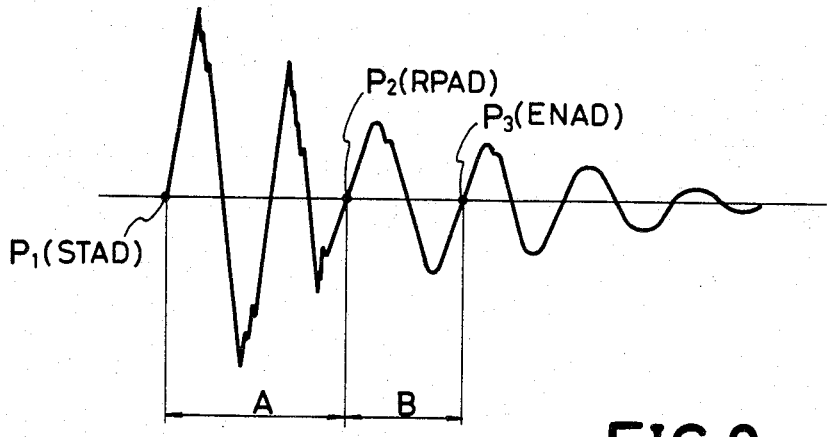
FIG. 8 is a diagram showing a rhythm tone waveshape.

FIG. 7 illustrates in block form an electronic musical instrument according to a second embodiment of the present invention. The electronic musical instrument shown in FIG. 7 also has an automatic rhythm performance device capable of producing 16 rhythm tones as shown in FIG. 2 or 4 for each rhythm selected, and of increasing the number of produced rhythm tones in response to operation of an EXP pedal 14*a*. The electronic musical instrument of FIG. 7 is entirely different from that shown in FIG. 1 as to how rhythm tones are generated. More specifically, the electronic musical instrument illustrated in FIG. 7 has a waveshape memory 30 storing therein 16 rhythm tone waveshapes which will be read successively on a time-division basis for the generation of rhythm tones. The waveshape memory 30 does not store full waveshapes of rhythm tones but partial waveshapes of the rhythm tones. FIG. 8 shows the waveshape of a certain rhythm tone by way of example, and the waveshape memory 30 stores an entire waveshape of an initial portion A of the rhythm tone, and the waveshape of a portion B (one cycle) for the remainder following the initial portion A. For producing a musical tone, musical tone data on the initial portion A are first read to generate a rhythm tone, and then musical tone data on the portion B are read repeatedly and given an envelope for generating a rhythm tone. The reason for such waveshape memory arrangement is to save the capacity of the waveshape memory 30.

Construction of the electronic musical instrument will be described in greater detail. For the ease of illustration, the rhythm tones will be numbered as shown in FIG. 2, and these numbers will be referred to as "rhythm tone numbers" ("1" for the tone of CABACA, "2" for the tone of CYMBAL(2), . . . ).

The electronic musical instrument of FIG. 7 includes a channel counter 31 in the form of a modulo-16-counter for counting up clock pulses Ø and issuing count outputs "0"–"15" as channel signals CH. A rhythm tone number generator 32 is responsive to a rhythm code RC issued from a rhythm selector 7 for converting the channel signals CH into rhythm numbers NO. Conversion from the channel signals CH to the rhythm numbers NO is effected as follows: Where the rhythm code RC is a rhythm code of bossa nova, the channel signals CH "0"-"15" are converted respectively into the rhythm tone numbers "1"-"16". Where the rhythm code RC is a rhythm code of 8-beat, the conversion is performed based on the following table:

| CH | NO | CH | NO |
|---|---|---|---|
| 0 | 5 | 8 | 14 |
| 1 | 2 | 9 | 1 |
| 2 | 3 | 10 | 9 |
| 3 | 4 | 11 | 15 |
| 4 | 7 | 12 | 11 |
| 5 | 6 | 13 | 16 |

-continued

| CH | NO | CH | NO |
|---|---|---|---|
| 6 | 10 | 14 | 13 |
| 7 | 8 | 15 | 12 |

Thus, the rhythm tone numbers NO are associated with the channel signals CH "0"-"15" in the order in which the rhythm tones are successively generated in response to depression of the EXP pedal 14*a*, as is apparent from FIGS. 2 and 4.

A rhythm pulse generator 33 responds to a rhythm code RC supplied from the rhythm selector 7 for generating 16 types of rhythm pulses which are issued as rhythm pulses RP from an output terminal Q1 on a time-division basis based on a rhythm tone number NO from the rhythm tone number generator 32. When the rhythm tone number NO is "1", the rhythm pulses for the tone of CABACA are produced, and when the rhythm tone number NO is "5", the rhythm pulses for the tone of HIGH-HAT(1) are generated. The rhythm pulse generator 33 generates rhythm pulses under the control of a rhythm switch 34.

Figure 9:
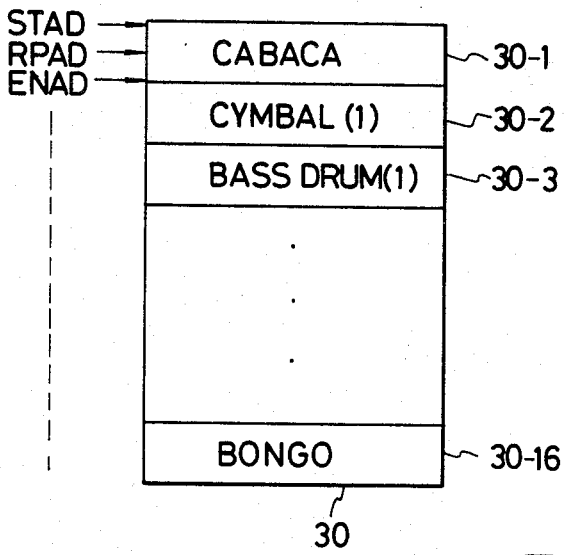
FIG. 9 is a diagram showing a waveshape memory shown in FIG. 7.

As shown in FIG. 9, the waveshape memory 30 comprises a ROM having 16 storage areas 30-1 through 30-16 each storing 16 types of rhythm tone waveshapes. Each of the storage areas 30-1 through 30-16 has a start address STAD for storing therein first musical tone data (at a point P1 in FIG. 8) on the initial portion A of the rhythm tone waveshape, a repeat address RPAD for storing therein first musical tone data (at a point P2 in FIG. 8) on the portion B, and an end address ENAD for storing therein final musical tone data (at a point P3 in FIG. 8) on the portion B. The musical tone data stored in the waveshape memory 30 can be read out in response to address data ADD issued from an address control circuit 35 and are fed to a multiplier 36.

The address control circuit 35 generates the address data ADD in synchronism with the clock pulses Øo. The address control circuit 35 includes an end address memory 38 comprising a ROM storing therein relative end addresses ENADa of the 16 types of rhythm tone waveshapes stored in the waveshape memory 30. The relative end addresses ENADa are the differences between actual end addresses ENAD and start addresses STAD of the respective rhythm tone waveshapes. The memory 38 issues the relative end address ENADa of the rhythm tone waveshape specified by a rhythm tone number NO to an input terminal A of a comparator 39.

A random data generator 40 serves to generate data randomly between +K and −K (K: a constant) each time a clock pulse Øo is supplied, the random data generator 40 has an enable terminal EN. When a signal of "1" is applied to the enable terminal EN, the random data generator 40 issues random data RD to a terminal of an adder 41. When a signal of "0" is applied to the enable terminal EN, the random data generator 40 issues data "0" to the adder 41.

A repeat address memory 42 comprises a ROM storing relative repeat addresses RPADa of the 16 types of rhythm tone waveshapes stored in the waveshape memory 30. The relative repeat addresses RPADa are the differences between actual repeat addresses RPAD and start addresses STAD of the respective rhythm tone waveshapes. The memory 42 issues the relative repeat address RPADa of the rhythm tone waveshape specified by a rhythm tone number NO to the other input terminal of the adder 41 and to an input terminal B of a comparator 43. The repeat address memory 42 also stores a control signal RNC for controlling the random data generator 40 in the form of 37 1" or "0" corresponding to each rhythm tone. The control signal RNC is read out in response to the rhythm tone number NO and applied to the enable terminal EN. The control signal is added in view of the fact that the random data RD should be produced dependent on the rhythm tone; the control signal RNC becomes a signal of "1" for the tone of CYMBAL, for example (that is, the random data RD is issued from the random data generator 40).

A start address memory 44 comprises a ROM storing therein start addresses STAD of the respective rhythm tone waveshapes stored in the waveshape memory 30. The start address memory 44 issues the start address STAD of the rhythm tone waveshape specified by a rhythm tone number NO to the other input terminal of the adder 41.

The adder 41 serves to add the output from the random data generator 40 and the relative repeat address RPADa, and issues the sum signal as repeat data RPD to a terminal T1 of an address data generator 48.

Figure 10:
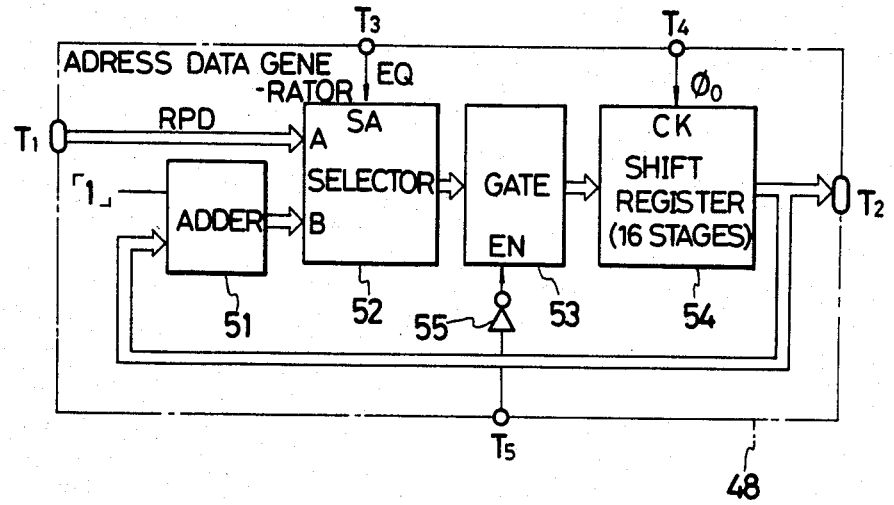
FIG. 10 is a block diagram illustrative of an address data generator shown in FIG. 7.

As illustrated in FIG. 10, the address data generator 48 comprises an adder 51, a selector 52, a gate 53, a shift register 54, and an inverter 55. The adder 51 adds a signal of "1" to an output from the shift register 54. The selector 52 selects and issues either data supplied to its input terminal A or data fed to its other input terminal B in response to a signal applied to select terminal SA. The gate 53 is opened when a signal of "1" is supplied to an enable terminal EN thereof and closed when a signal of "0" is supplied to the enable terminal EN. The shift register 54 is in the form of a 16-stage shift register for shifting data in each stage in response to a clock pulse Øo. An output from the shift register 54 is issued through a terminal T2 as relative address data ADDa to an input terminal B of the comparator 39, to an input terminal of an adder 46, and to an input terminal A of the comparator 43.

The comparator 39 compares the relative end address ENADa and the relative address data ADDa, and issues a coincidence signal EQ1 to a terminal T3 of the address data generator 48 when they agree with each other. The adder 46 adds the relative address data ADDa and the start address STAD, and issues the sum as address data ADD to an address terminal AT of the waveshape memory 30. The comparator 43 compares the relative address data ADDa and the relative repeat address RPADa, and issues a coincidence signal EQ2 to an envelope generator 56 when they are in conformity with each other.

Operation of the address control circuit 35 is as follows: When the rhythm switch 34 is open, the output from an inverter 57 is a signal of "1" which is supplied through an OR gate 58 to an input terminal of the inverter 55 (FIG. 10) of the address data generator 48. Thus, a signal of "0" is applied to the enable terminal EN of the gate 53 to thereby open the latter, whereupon data "0" is supplied to an input terminal of the shift register 54. The data "0" is then successively read into the shift register 54 in response to clock pulses Øo. Accordingly, as long as the rhythm switch 34 remains de-activated, the stages of the shift register 54 are in the cleared condition. When the rhythm switch 34 is turned on, the rhythm pulse generator 33 generates 16 types of rhythm pulses as dictated by a rhythm code RC, and issues these rhythm pulses through the output terminal Q1 successively on a time-division basis in response to a rhythm tone number NO. Now, it is assumed that the rhythm code RC issued from the rhythm selector 7 is a rhythm code of 8-beat.

If the channel signal CH "0" is fed from the channel counter 31, then the rhythm tone number NO "5" is generated from the rhythm tone number generator 32. The rhythm pulse generator 33 then produces rhythm pulses RP for the tone of HIGH-HAT(1) through the output terminal Q1 (the rhythm tone number for the tone of HIGH-HAT(1) is "5" as shown in FIG. 2). If the rhythm pulses RP for the tone of HIGH-HAT(1) are of the signal of "1", this signal is fed through the OR gate 58 to the input terminal of the inverter 55 (FIG. 10), which produces a signal of "0". The gate 53 allows data "0" to be issued and read into the shift register 54 in response to the clock pulses Øo. When 15 clock pulses Øo are applied, that is, when the channel signal CH goes back to "0" (the rhythm tone number NO is "5"), the data "0" read into the shift register 54 is issued out thereof and supplied through the terminal T2 to the input terminal of the adder 46 (FIG. 7) and simultaneously to one of the input terminals of the adder 51 (FIG. 10). At this time, the rhythm tone number NO is "5", and hence the start address memory 44 issues the start address STAD of the tone of HIGH-HAT(1) to the other input terminal of the adder 46. As a result, when the data "0" is fed to one of the input terminals of the adder 46, it issues the start address STAD of the tone of HIGH-HAT(1) which is supplied as address data ADD to the address terminal AT of the waveshape memory 30. When the data "0" issued from the shift register 54 is supplied to said one input terminal of the adder 51, it issues data "1" to the input terminal of the shift register 54 through the selector 54 and the gate 53. This data "1" is read into the shift register 54 in response to clock pulses Ø, and will be read out of the shift register 54 when the channel signal CH goes back to "0" at a next time (the rhythm tone number NO is "5"). When the data "1" is fed from the shift register 54, the adder 46 produces data {(start address STAD of the tone of HIGH-HAT(1)) +"1"} which is supplied as address data ADD to the waveshape memory 30, and the adder 51 issues data "2". Likewise, increasing address data ADD of the tone of HIGH-HAT(1) is issued from the adder 46 each time the channel signal CH becomes "0", and supplied to the address terminal AT of the waveshape memory 30. Therefore, musical tone data on the initial portion A of the tone of HIGH-HAT(1) is successively read out of the waveshape memory 30 and supplied to the multiplier 36.

When the shift register 54 issues the same data as the relative repeat address RPADa of the tone of HIGH-HAT(1) at the time of the channel signal NO "0", the comparator 43 issues a coincidence signal EQ2 to a terminal T2 of the envelope generator 56. When the address data ADD is further increased with the channel signal CH "0", musical tone data on the portion B of the tone of HIGH-HAT(1) is read out of the waveshape memory 30 and fed to the multiplier 36. As the shift register 54 issues the same data as the relative end address ENADa of the tone of HIGH-HAT(1), the comparator 39 delivers a coincidence signal EQ1 (signal of "1") to the select terminal SA of the selector 52 (FIG. 10). This coincidence signal causes repeat address data RPD (=RPADa+RD) supplied to the input terminal A of the selector 52 to be issued from the output terminal of the selector 52 to the input terminal of the shift register 54 through the gate 53. The repeat address data RPD is read into the shift register 54 in response to clock pulses Øo, and will be issued from the shift register 54 when the channel signal CH goes back to "0" at a next time. When the repeat address data RPD is issued from the shift register 54 with the channel signal CH "0", data {start address STAD of the tone of HIGH-HAT(1) RPD} is issued as address data ADD from the adder 46 to the waveshape memory 30, from which the first musical tone data on the portion B of the waveshape of the tone of HIGH-HAT(1) is then read again (provided the random data RD is "0"). Where the random data RD is not "0", musical tone data in the vicinity of the first musical tone data of the portion B is read out. Then, the musical tone data on the portion B of the tone of HIGH-HAT(1) is successively read out of the waveshape memory 30 each time the channel signal CH goes back to "0". When the shift register 54 issues again the same data as the relative end address ENADa of the tone of HIGH-HAT(1), the repeat address data RPD is read again into the shift register 54, and the foregoing process will be repeated.

The address control circuit 35 operates in the foregoing manner when the channel signal CH is "0". The address control circuit 35 will operate in the same manner when the channel signal CH is any one of "1"–"15". As a consequence, the waveshape memory 30 issues musical tone data on the tone of CYMBAL(1) when the channel signal CH is "1", musical tone data on the tone of BASS DRUM(1) when the channel signal CH is "2", . . . , and musical tone data on the tone of BONGO when the channel signal CH is "15" (provided the rhythm code RC is an 8-beat rhythm code). The musical tone data of the rhythm tones as described above are read out after the corresponding rhythm pulses have been issued from the rhythm pulse generator 33.

The envelope generator 56 is composed of a ROM storing 16 envelope data groups corresponding respectively to the rhythm tones and a control circuit. In response to a rhythm tone number NO applied to a terminal T4, the corresponding envelope data is read out of the ROM and issued through a terminal T1 to the multiplier 36. When rhythm pulses RP (signal of "1") are supplied to a terminal 3 of the envelope generator 56 at the time the rhythm tone number NO is "5", the envelope generator 36 issues data "1" through the terminal T1, and then repeatedly issues data "1" each time the rhythm tone number NO goes back to "5". With the coincidence signal EQ2 fed to the terminal T2 when the rhythm tone number NO is "5", the envelope data on the tone of HIGH-HAT(1) stored in the ROM in the envelope generator 56 is successively read out and issued through the terminal T1. The envelope generator 56 thus issues data "1" to the multiplier 36 as long as the musical tone data on the initial portion A of the tone of HIGH-HAT(1) is read out of the waveshape memory 30. Accordingly, the musical tone data on the tone of HIGH-HAT(1) is issued from the multiplier 36. While the musical tone data on the portion B of the tone of HIGH-HAT(1) is being repeatedly issued from the waveshape memory 30, the envelope generator 56 issues envelope data on the tone of HIGH-HAT(1) successively to the multiplier 36. The multiplier 36 then gives an envelope to musical tone data on the portion B. The same operation will be carried out for other rhythm tone numbers.

With the circuit arrangement shown in FIG. 7, when an 8-beat rhythm, for example, is selected by the rhythm selector 7, the multiplier 36 successively issues musical tone data on the tone of HIGH-HAT(1), the tone of CYMBAL(1), . . . , and the tone of BONGO to a gate 60 in the order shown in FIG. 4 each time the channel signal CH changes from "0" through "15".

Figure 11:
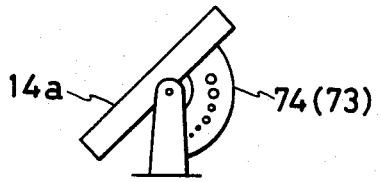
FIG. 11 is a side elevational view of an EXP pedal illustrated in FIG. 7.

The gate 60 is opened when a signal of "1" is supplied to a control terminal C thereof and is closed when a signal of "0" is supplied to the control terminal C. The control terminal C is connected to a common terminal CM of a switch 61 having a contact A coupled to a line for feeding a signal of "1" and a contact B to an output terminal of a comparator 62. The comparator 62 compares data supplied to input terminals A, B thereof, and produces a signal of "1" when the data applied to the input terminal A is equal to or smaller than the data applied to the input terminal B, and a signal of "0" when the data applied to the input terminal A is greater than the data applied to the input terminal B. The channel signal CH is fed to the input terminal A and an output from a CdS (Cadmium Sulfide) photosensitive circuit 63. The CdS circuit 63 is composed of a CdS photoconductive cell 64 and a resistor 68 connected in series therewith, a CdS photoconductive cell 65 and a resistor 69 connected in series therewith, a CdS photoconductive cell 66 and a resistor 70 connected in series therewith, and a CdS photoconductive cell 66 and a resistor 70 connected in series therewith. The CdS photoconductive cells 64–67 have ends connected to a line of a voltage +V, and the resistors 68–71 have ends grounded. Signals at the junctions between the CdS photoconductive cells 64–67 and the resistors 68–71 are supplied to the input terminal B of the comparator 62. The CdS photoconductive cells 64–67 are disposed adjacent to a code plate 73 attached to the EXP pedal 14*a*. The EXP pedal 14*a* has two sectorial code plates 73, 74 extending parallel to each other with a lamp positioned therebetween. The code plate 73 has 4×16 holes 75, 75, . . . which will be opened and closed according to binary codes. The four CdS photoconductive cells 64–67 are positioned such that they will receive light rays from the lamp through the holes 75, 75, . . . As shown in FIG. 11, the code plate 74 has a plurality of holes having progressively larger sizes. A CdS photoconductive cell 77 (FIG. 7) is disposed in a position where it can receive a light ray from the lamp through the holes in the code plate 74. When the EXP pedal 14*a* is not depressed at all, the CdS photosensitive circuit 63 issues data "0" ("0000" in binary notation), and the CdS photoconductive cell 77 presents a highest resistance. As the EXP pedal 14*a* is progressively depressed, the CdS photosensitive circuit 63 sucessively issues data "1", "2", . . . , and the resistance of the CdS photoconductive cell 77 becomes progressively smaller. When the EXP pedal 14*a* is fully depressed, the CdS photosensitive circuit 63 issues data "15" ("1111" in binary notation), and the CdS photoconductive cell 77 presents a lowest resistance.

An accumulator 79 accumulates outputs from the gate 60 while the channel signal CH changes from "0" through "15", temporarily latches the accumulated data, and then issues the latched data to a D/A converter 80. Then, the accumulator 79 clears accumulated data and accumulates again outputs from the gate 60 while the channel signal CH changes from "0" through "15". The foregoing operation will then be repeated. The D/A converter 80 coverts the output data from the accumulator 79 into an analog signal, which is fed to a sound system 81.

A musical tone signal generator 82 is responsive to operation of a key or keys of a keyboard 83 for generating musical tone signals that are supplied through the CdS photoconductive cell 77 and a resistor parallel thereto to the sound system 81. The sound system 81 is composed of amplifiers, loudspeakers and other components for generating musical tones based on an output signal (rhythm tone signal) from the D/A converter 80 and an output signal (keyboard musical tone signal) from the musical tone signal generator 82.

When the EXP pedal 14*a* is not depressed at all, the CdS photosensitive circuit 63 issues data "0" and the comparator 62 issues a signal of "1" only when the channel signal CH is "0". As a consequence, when the rhythm code RC is an 8-beat rhythm code, only musical tone data on the tone of HIGH-HAT(1) is issued from the gate 60, and thus only the tone of HIGH-HAT(1) is generated as a rhythm tone from the sound system 81. When the CdS photosensitive circuit 63 issues data "3", for instance, in response to depression of the EXP pedal 14*a* to a certain depth, the gate 60 is opened only when the channel signal CH is "0"–"3". As a result, musical tone data on the tone of HIGH-HAT(1), the tone of CYMBAL(1), the tone of BASS DRUM(1), and the tone of CYMBAL(2) pass through the gate 60, so that these tones can be produced by the sound system 81. When the EXP pedal 14*a* is completely depressed, the CdS photosensitive circuit 63 issues data "15", and the comparator 62 issues a signal of "1" at all times irrespective of the channel signal CH. Therefore, all of the musical tone data issued from the multiplier 36 pass through the gate 60 and all musical tones are produced as rhythm tones from the sound system 81.

The relative repeat address RPADa is address-modified by the random data RD in the foregoing embodiment for the following reasons: If the waveshape of the portion B is repeatedly read out of the waveshape memory 30 based only on the relative repeat address RPADa, then the reproduced musical tone waveshapes would have regularity, and particularly noise-based musical tones such as cymbal tones would be different from natural tones produced by actual musical instruments. With this embodiment, the relative repeat address RPADa is address-modified by the random data RD to thereby remove regularity from the reproduced musical tone waveshapes, so that the reproduced musical tones will approach the tones of actual musical instruments.

With the arrangement of the present invention, an electronic musical instrument includes detector means for detecting the extent of depression of an EXP pedal, and selector means for selecting a rhythm tone source in response to an output from the detector means, so that a rhythm tone will be produced from a rhythm tone source selected by the selector means. Therefore, not only the volume of musical tones generated but also the effect of performance of rhythm tones can be increased through operation of the EXP pedal.

Although certain preferred embodiments have been shown and described, it should be understood that many changes and modifications may be made therein without departing from the scope of the appended claims.

What is claimed is:

1. An automatic rhythm performance device suitable for incorporation into an electronic musical instrument having an expression pedal for controlling the volume of a musical tone produced by the electronic musical instrument itself, comprising:

detecting means for detecting an operation amount of said expression pedal;

rhythm selecting means for selecting a rhythm to be performed among a plurality of rhythms;

pattern signal generating means for generating a plurality of pattern signals representing rhythm patterns determined by said selected rhythm;

sound means, receiving said pattern signals, for converting said pattern signals to rhythm instrument tones respectively, said rhythm instrument tones being sounded in accordance with the corresponding rhythm patterns; and control means for changing the number of said rhythm instrument tones sounded in accordance with said detected operation amount of said expression pedal.

2. An automatic rhythm performance device according to claim 1, wherein said sound means comprises rhythm tone signal generating means for generating rhythm tone signals in response to said pattern signals respectively, said rhythm tone signals having components corresponding to predetermined tone colors respectively; and converting means for converting said rhythm tone signals to tones, each of which has a corresponding tone color.

3. An automatic rhythm performance device according to claim 1, wherein said control means comprises gate means for passing or stopping said pattern signals received by said sound means in accordance with said operation amount, said sound means generating rhythm instrument tones corresponding to the passed pattern signals only.

4. An automatic rhythm performance device according to claim 1, wherein said pattern signal generating means comprises a pattern memory for storing said rhythm patterns.

5. An automatic rhythm performance device suitable for incorporation into an electronic musical instrument having an expression pedal for controlling the volume of a musical tone of the electronic musical instrument itself, comprising:

detecting means for detecting an operation amount of said expression pedal;

rhythm selecting means for selecting a rhythm to be performed among a plurality of rhythms;

pattern pulse generating means for generating pattern pulses representing rhythm patterns determined by said selected rhythm respectively;

waveshape memory means for storing a plurality of waveshape data respectively representing waveshapes of plural rhythm tones to be produced and for outputting said plural respective waveshape data in accordance with said rhythm pattern pulses respectively;

control means for controlling the number of said plural waveshape data outputted by said memory means in accordance with said detected operation amount of said expression pedal; and sound means for converting said controlled waveshape data to rhythm tones respectively.

6. An automatic rhythm performance device according to claim 5, wherein each of said waveshape data comprises data representative of an attack portion of said waveshape and data representative of the part of the other portion of said waveshape following said attack portion.

7. An automatic rhythm performance device according to claim 6, which further comprises address means for addressing said waveshape memory means to first read the attack portion data and then to repetitively read said part.

8. An automatic rhythm performance device for use with an electronic musical instrument having an expression pedal or like means for controlling the volume of the musical tones produced by said instrument, comprising:

rhythm tone producing means for concurrently producing a plurality of different rhythm instrument tones; and control means for controlling the number of different rhythm instrument tones provided by said rhythm tone producing means in accordance with the operation amount of said expression pedal or like means.

9. An automatic rhythm performance device according to claim 8, wherein said rhythm tone producing means concurrently produces said plurality of rhythm instrument tones on respective time division multiplex channels, and wherein said control means independently controls on a channel by channel basis the extent to which the instrument tone of that channel is included among the tones outputted by said rhythm tone producing means.

10. An automatic rhythm performance device according to claim 9, wherein said control means comprises:

first means for producing a numerical signal ranging in value up to n, where n is the number of said channels, in accordance with the operation amount of said expression pedal or like means; and second means for including in the rhythm instrument tones provided by said rhythm tone producing means only those tones assigned to respective channels having channel numbers in a particular relationship with the numeric signals produced by said first means.

* * * * *